United States Patent [19]

van Seumeren

[11] Patent Number: 4,605,132

[45] Date of Patent: Aug. 12, 1986

[54] LIFTING TOOL

[76] Inventor: Adelbert M. D. G. van Seumeren, Mr. van Coothstraat 4, 5141 AS Waalwijk, Netherlands

[21] Appl. No.: 607,227

[22] Filed: May 2, 1984

[30] Foreign Application Priority Data

May 4, 1983 [NL] Netherlands ..... 8301580

[51] Int. Cl.[4] ..... B66C 23/42

[52] U.S. Cl. ..... 212/185; 212/192; 212/230; 212/238; 414/545

[58] Field of Search ..... 212/182–185, 212/187, 188, 189–193, 230, 264, 238, 261; 114/268, 361; 414/543, 545, 558, 563; 296/37.5, 296/37.6

[56] References Cited

U.S. PATENT DOCUMENTS

| | | | |
|---|---|---|---|
| 2,544,553 | 3/1951 | Eakin | 212/185 |
| 3,357,573 | 12/1967 | Stukins | 212/183 |
| 3,786,937 | 1/1974 | Faust | 212/264 |
| 3,861,534 | 1/1975 | Birdwell | 212/192 |
| 4,112,863 | 9/1978 | Nelson | 114/264 |
| 4,268,213 | 5/1981 | Obbink | 414/563 |
| 4,406,574 | 9/1983 | Riley | 414/543 |
| 4,419,038 | 12/1983 | Pendergraft | 212/182 |

*Primary Examiner*—Galen L. Barefoot
*Assistant Examiner*—Stephen P. Avila
*Attorney, Agent, or Firm*—John P. Snyder

[57] ABSTRACT

A lifting device for a marine vessel having a foot part that can be put on a flat support and an upper part adapted to pivot with respect to the foot part about a vertical axis and having at least one lifting arm and the lifting arm being extendible by a hydraulic cylinder assembly.

8 Claims, 3 Drawing Figures

LIFTING TOOL

Figure 1:
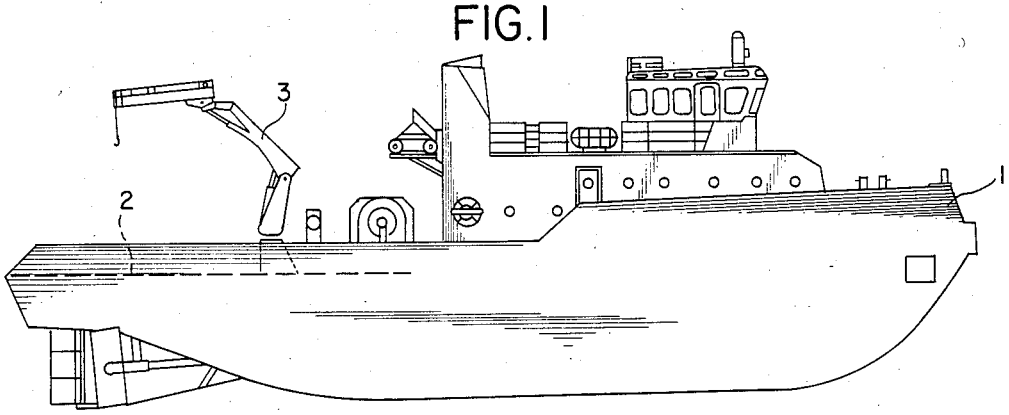

The invention relates to a lifting device principally comprising a foot part that can be put on a flat support and an upper part adapted to pivot with respect to said foot part about a vertical axis and having at least one lifting arm.

The invention has for its object to improve the aforesaid tool in a manner such that it can be employed on places which are normally used for other purposes, for example, the deck of a ship, where the lifting tool can be temporarily used and subsequently be readily removed so that the place concerned is again free.

The lifting tool embodying the invention is distinguished in that the foot part is connected with the support by means of one or more hinge members, whilst means are provided for tilting the vertical hinge shaft horizontally with respect to the support between the foot part and the upper part.

Thanks to these hinge members the lifting tool can be tilted away into a flat position after use so that the space above the same remains free, for example, for improving visibility, which is important for a vessel or a vehicle or for swinging cables overhead for other purposes.

When the support is formed by a horizontal plate having an opening that can be covered by a removable plate portion, the invention proposes to arrange the hinge members near a rim of said opening. In this way the lifting tool can be tilted through the opening below the support, so that the support is completely free and may be used, for example, for deck load.

The tilting means are preferably formed by at least one hydraulic ram arranged below the plate-shaped support and the foot part. The top side of the plate-shaped support is not hindered by the tilting means.

The lifting tool is furthermore formed in accordance with the invention preferably by two or more relatively pivotable joints or telescopic sections between which hydraulic rams are operative for folding down the lifting device before it is tilted away.

The invention will be described more fully with reference to the accompanying drawing showing an embodiment.

Figure 2:
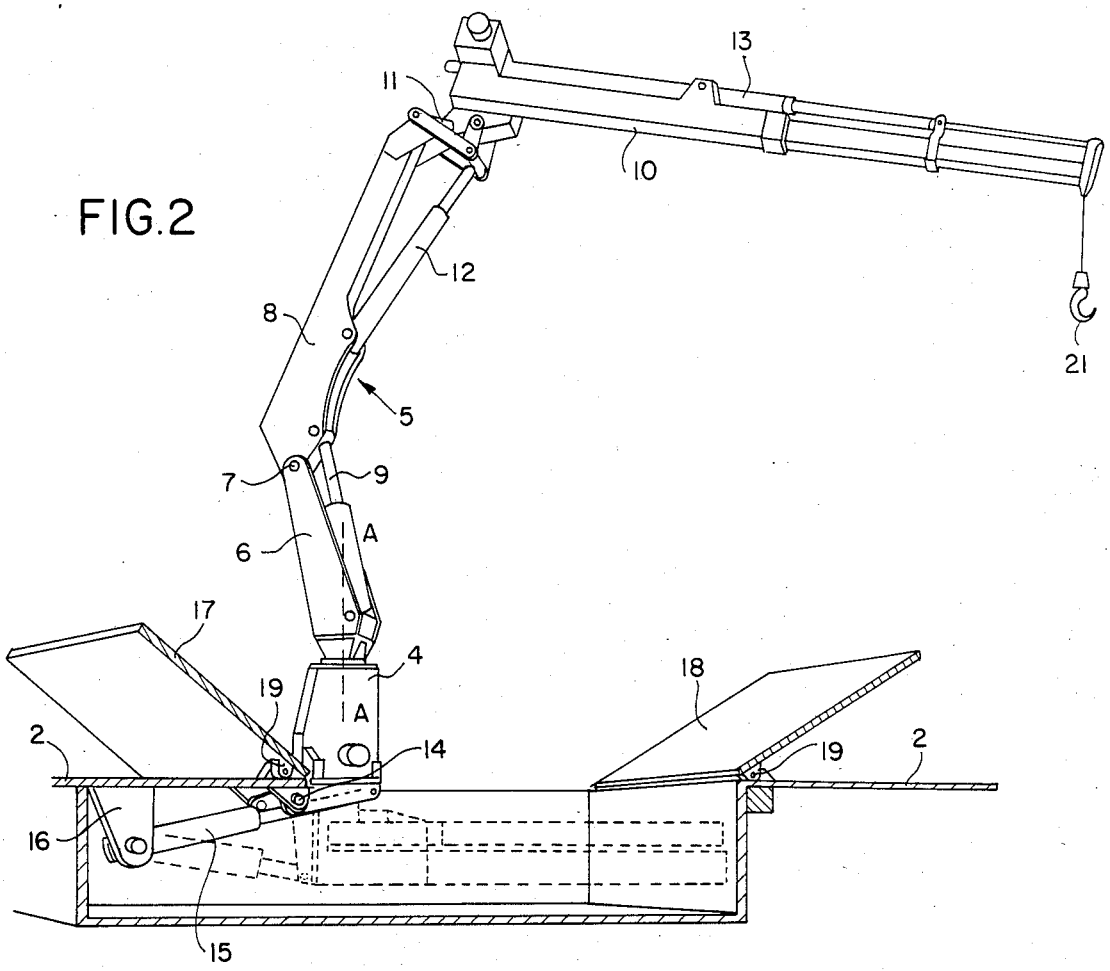
Figure 3:
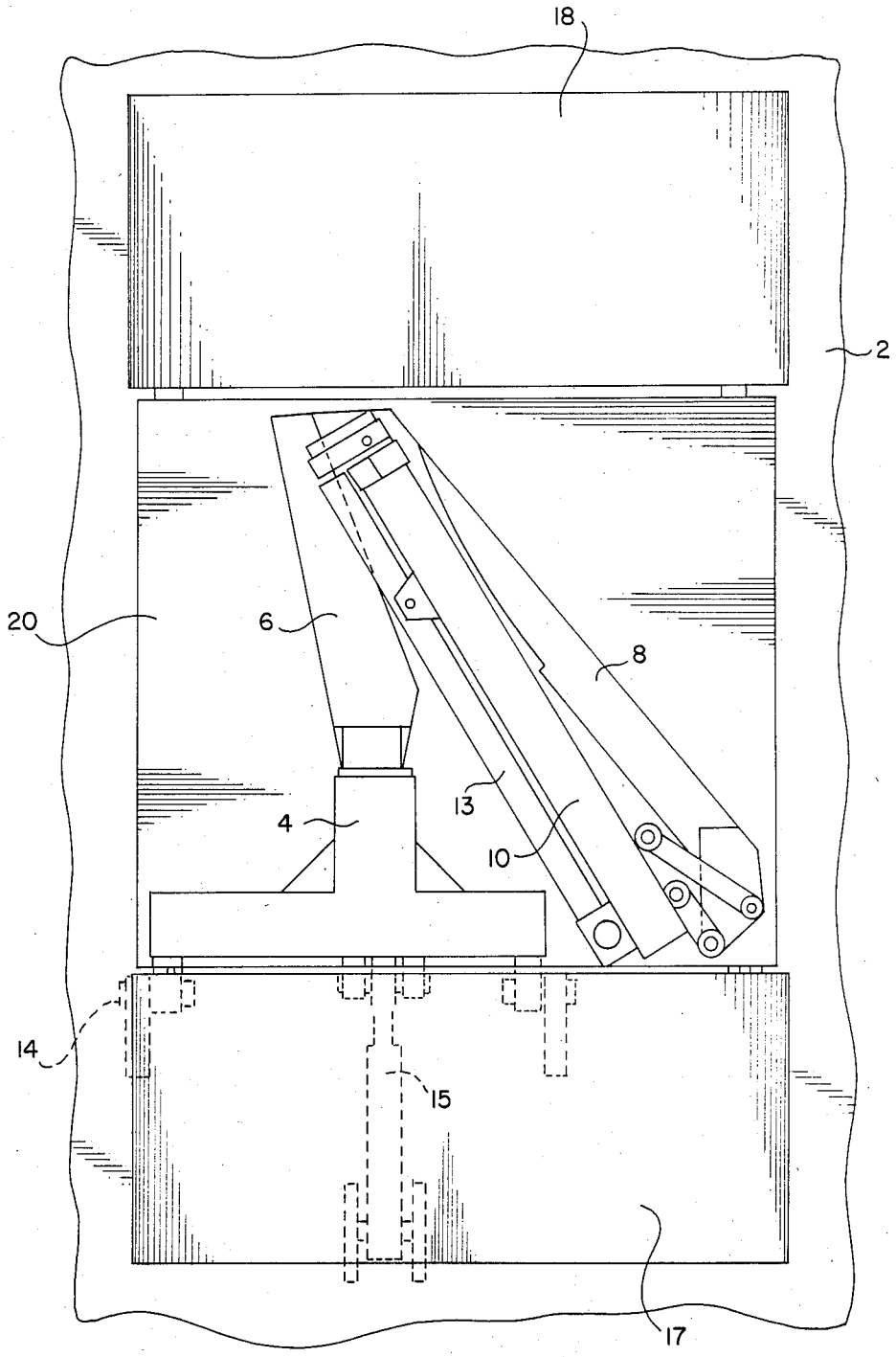

The drawing shows in:

FIG. 1 a side elevation of a vessel provided with a foldable and tiltable lifting tool embodying the invention, FIG. 2 a perspective view an an enlarged scale of the lifting tool suitable for use on the vessel of FIG. 1, FIG. 3 a plan view of the lifting tool shown in FIG. 2 in the folded and tilted state.

Reference numeral 1 in the first figure designates a vessel in the form of a work ship, a detailed description of which is omitted because the vessel may be any ship and lies without the scope of the invention. It is only noted that the quarter-deck 2 of the vessel 1 is provided with a lifting tool formed by a hydraulic crane 3, which may be used for lifting loads onto and from the ship. After use the lifting tool has to be tilted away in order to give the quarter-deck free, for example, for towing cables, deck-cargos and the like.

The tool 3 shown, details of which are shown in FIG. 2 mainly comprises a foot part 4 and an upper part 5 which is pivotable with respect to a vertical pivotal axis A—A. The upper part has a first joint 6 and a second joint 8 which is pivotable about an pin 7. Between said two joints is operative a hydraulic ram 9. The upper part has furthermore a lifting arm 10, which is adapted to move up and down with respect to the second joint 8, said upward and downward movement being ensured by a hydraulic ram 12. The lifting arm 10 has three telescopic sections, above which a hydraulic three-stage ram 13 is arranged for lengthening and shortening the arm 10 respectively. At the end of the arm is suspended a lifting hook, which may be replaced by any other suitable hoisting member.

According to the invention the foot part 4 is pivotally arranged on the plate-shaped support, in this case the deck 2 by means of hinge members 14. The hinge members comprise a horizontal pivot pin (see also FIG. 3), the pins being located below the deck 2. Between the foot part 4 and the underside of the deck 2 a hydraulic ram 15 is operative, which is pivoted on the one hand to the foot part 4 and on the other hand to a support 16 on the underside of said deck. The deck itself is equipped with removable plate portions 17, 18, which may be designed in any way. Referring to FIG. 2 these plates can be tilted up around hinges 19 with respect to the deck 2 so that an opening 20 is released in the plate-shaped support or deck 2. Into this opening can be tilted down the lifting tool 3 in the folded state. This is performed as follows.

Starting from the position shown in FIG. 2 the telescopic arm 10 is drawn in after the lifting tool has been used and subsequently it is tilted against the second joint 8 by means of the ram 12. By again tilting in the second joint 8 by means of the ram 9 the lifting tool is folded in the position shown in FIG. 3. By subsequently tilting the foot part 4 about the hinge members 14 by drawing in the ram 15, the folded crane can be tilted through the opening 20 below the deck 2, and after closing the plate-shaped portions 17, 18 the deck is completely free.

For putting the lifting tool 3 into operation, the operations described above are performed in the reverse order.

The invention is not limited to the embodiment described above. For example, the lifting tool may be designed in any suitable way, for example, in the form of one column replacing the joints 6 and 8. This column itself may be telescopic. The plate-shaped support 2 need not be formed by a deck. It may be the top side of a deck house. The plate-shaped support 2 need not be arranged on a vessel, it may also be arranged on a vehicle.

What is claimed is:

1. In a marine vessel having a deck and a shallow storage space immediately below said deck, said storage space extending laterally to define a width and longitudinally to define a length, a lifting tool adapted to be moved between a folded, stowed position within said storage space below said deck and a working position upstanding from said storage space, said lifting tool having a foot part and an upper part connected thereto about a first axis adapted to be disposed generally horizontally and longitudinally of said storage space when the lifting tool is in said stowed position, said upper part including a first section directly connected to said foot part about said first axis and extending generally in the direction of said first axis to terminate in a free end, first pivot means for pivotally connecting said foot part about a generally horizontal second axis extending laterally of said storage space and first hydraulic means for swinging said foot part about said second axis, said upper part including a second section having a length greater than the cumulative length of said foot part and said first section, second pivot means for pivotally connecting one end of said second section to said free end of said first section about a third axis allowing said second section to jackknife relative to said first section and said foot part with that end of the second section remote from said third axis being disposed laterally of said foot part within said storage space when said lifting tool is in said stowed position, and second hydraulic means for swinging said second section about said third axis.

2. In a marine vessel as defined in claim 1 including a third section and third pivot means for pivotally connecting one end of said third section to said end of the second section remote from said third axis about a fourth axis parallel to said third axis allowing said third section to jackknife relative to said second section with that end of said third section remote from said fourth axis being disposed in close proximity to said second axis within said storage space when said lifting tool is in said stowed position, and third hydraulic means for swinging third section about said fourth axis.

3. In a marine vessel as defined in claim 2 wherein said third section is disposed in offset relation to said second section so that said end of the third section remote from said fourth axis is overlapped with both said first section and said second section when said lifting tool is in said stowed position.

4. In a marine vessel as defined in claim 3 wherein said third section includes a plurality of telescopic portions and load attaching means carried by one of said telescopic portions.

5. In a marine vessel as defined in claim 1 wherein said first section extends at an oblique angle from said foot part and said first axis.

6. In a marine vessel as defined in claim 1 including cover means for closing said storage space to provide a load bearing surface when said lifting tool is stowed.

7. In a marine vessel as defined in claim 2 wherein said foot part comprises laterally spaced hinge members disposed beneath said deck adjacent one end of said storage space whereby said foot part occupies a substantial portion of said width of the storage space.

8. In a marine vessel as defined in claim 7 wherein said third section is disposed in offset relation to said second section so that said end of the third section remote from said fourth axis is overlapped with both said first section and said second section when said lifting tool is in said stowed position.

* * * * *